US005263357A

United States Patent [19]

Dumais

[11] Patent Number: 5,263,357

[45] Date of Patent: Nov. 23, 1993

[54] HAULABLE DEVICE FOR RECTIFYING THE SHAPE OF A MISSHAPEN UNIBODY FRAME

[76] Inventor: Christian Dumais, 1045 St-Roch, Terrebonne, Quebec, Canada, J6W 5C9

[21] Appl. No.: 963,108

[22] Filed: Oct. 19, 1992

[51] Int. Cl.[5] ..... B21D 1/12

[52] U.S. Cl. ..... 72/457; 72/705

[58] Field of Search ..... 72/457, 705

[56] References Cited

U.S. PATENT DOCUMENTS 3,034,563 5/1962 Gaspar et al. ..... 72/455
4,660,405 4/1987 Widegren et al. ..... 72/447
4,854,151 8/1989 Belgarde ..... 72/447
4,920,781 5/1990 Horan et al. ..... 72/705

FOREIGN PATENT DOCUMENTS 853003 10/1970 Canada .

*Primary Examiner*—Lowell A. Larson
*Attorney, Agent, or Firm*—Collard & Roe

[57] ABSTRACT

Device for rectifying the shape of a unibody car having a misshapen unibody frame. The device is adapted as a trailer haulable by a conventional motor vehicle to a designated location to achieve the rectification thereat. It has a bar which can be set anywhere around said device for pulling a part of the frame, and may further define a drawbar.

13 Claims, 10 Drawing Sheets

FIG. 10
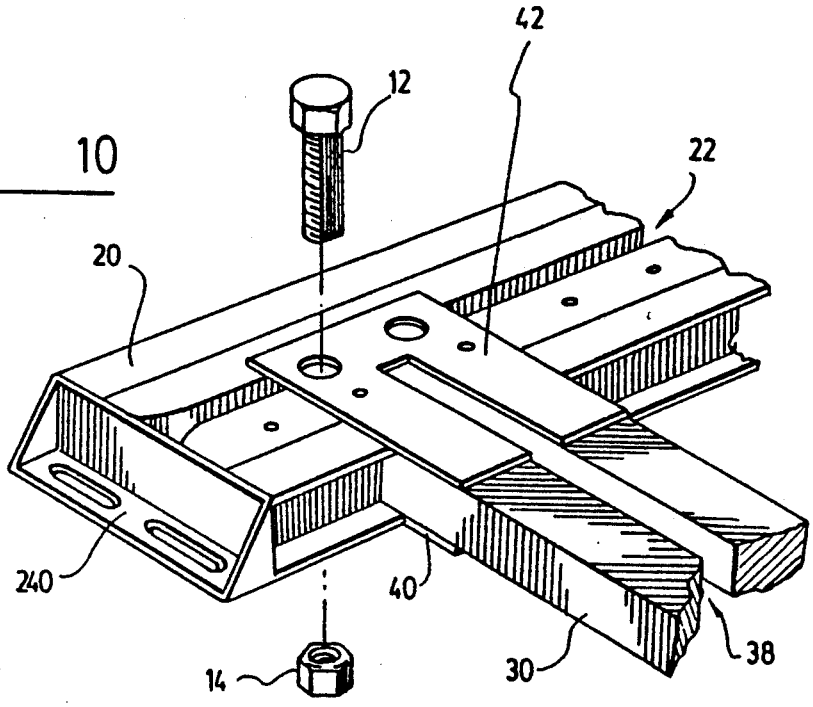
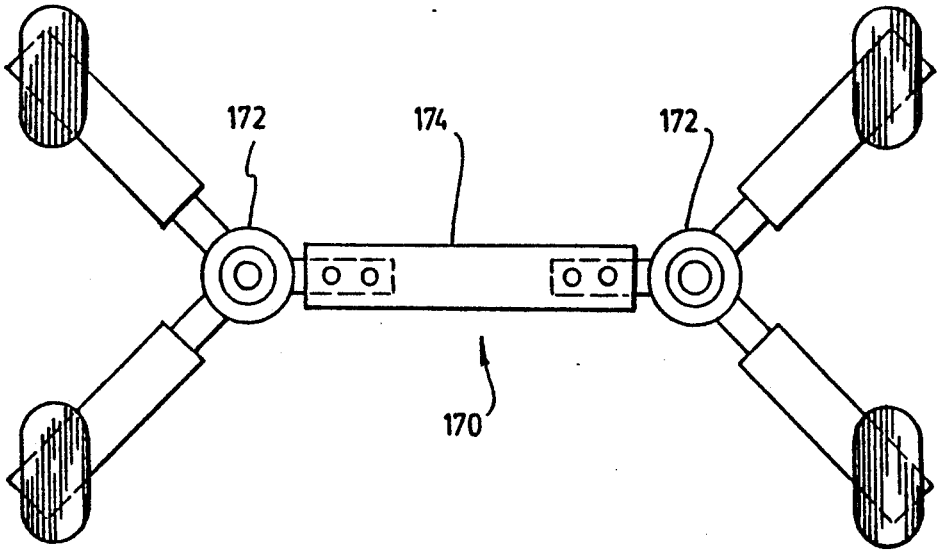
FIG. 9

HAULABLE DEVICE FOR RECTIFYING THE SHAPE OF A MISSHAPEN UNIBODY FRAME

FIELD OF THE INVENTION

The present invention relates to a device for rectifying the shape of a misshapen unibody frame that is adapted as a trailer towable by a conventional hauling vehicle, such as a car or a light truck.

DESCRIPTION OF PRIOR ART

Nowadays, almost all cars and light trucks are built with a unibody frame. It became a standard in the automobile industry since it had significantly reduced the weight of the cars.

Because of the important proportion of unibody cars and because the overall volume of cars and light trucks increases, there is a constantly greater demand for repairing those which had been involved in accidents and which still have a commercial value. It should be noted at this time that the term "car" used hereinafter in the disclosure refers to a unibody car, unibody light truck or any other similar vehicle that has a unibody.

In the past, specialized workshops have been the only ones which were able to straighten or realign the misshapen unibody frames since the rectification of such frames required bulky devices or equipments that where not well designed. Yet, many small workshops had begun repairing such cars. Additionally, some skillful car owners also perform repairs on their car after an accident. However, most of them are not equipped with unibody frame rectifying devices. When such operations have to be performed, the car is sent to a specialized workshop acting as a subcontractor and then sent back to the small workshop or the owner to complete the work.

The request of specialized workshop has some drawbacks. Among them, there is the need of moving the misshapen car to a specialized workshop and then back to the small workshop or owner, which is costly. There is also the fact that most of the specialized workshops are generally very busy and since their waiting list is usually important, the time needed to complete the operation may be very long. Finally, the worker of the small workshop or the owner cannot see or check the rectifying process.

U.S. Pat. Nos. 4,660,405 and 4,854,151 disclose work rack structures. However, some small workshops do not always need to have such devices on their floor space if they do not have a sufficient volume of cars that need to be rectified. Therefore, the purchase of such devices is not always a suitable solution because funds and valuable storage or floor space are non-profitable.

Another solution to the problem of the need to send the misshapen car to specialized workshops is the use of a mobile device as disclosed in Canadian patent no. 853,003. However, the device provided is very bulky and requires the use of a truck to haul it.

SUMMARY OF THE INVENTION

The object of the present invention is to provide a device for rectifying the shape of a misshapen body and which is adapted to be hauled by a conventional motor vehicle.

More particularly, the object of the present invention is to provide an improvement in a trailer adapted for rectifying the shape of a unibody car having a misshapen frame, the trailer comprising:

(a) a main frame comprising:
- at least two rails,
- at least two cross members having opposite ends,
- means for sliding one end of each cross member along a longitudinal axis of one corresponding rail, and the opposite end of each cross member along a longitudinal axis of another rail, and
- means for releasably securing one end of each cross member to one corresponding rail and the opposite end of each cross member to another rail;

(b) a wheel assembly comprising:
- at least one pair of wheels with suspension means,
- means for sliding the pair of wheels along the longitudinal axis of each rail, and
- means for releasably securing the pair of wheels with each of the rails;

(c) a bar having a length and opposite ends, the bar comprising:
- means for releasably securing one end of the bar with one corresponding rail or cross member,
- means for releasably securing an intermediate portion of the bar with one corresponding rail or cross member distinct from the one with which the end of the bar is releasably secured,
- a mast provided with means for releasably securing it on the bar near the end opposite the one releasably secured with a rail or cross member,
- pulling means releasably fastened on the mast and intended to mechanically connect a part of the misshapen frame with the mast to thus exert a traction on parts of said misshapen frame;

(d) means to load the car on the main frame;

(e) means for firmly fastening rocker panels of the car to the main frame, the means being releasably secured to the main frame;

(f) reference means for positioning the parts of the misshapen frame under traction; and (g) optional means to lift the car.

The improvement wherein the bar is releasably secured to the main frame at two distant points thereof and at any location around said main frame, said bar being intended, when substantially parallel with rails, to have one end releasably secured with one cross member, an intermediate portion releasably secured with another cross member and its opposite end provided with means to thus releasably secure it with an appropriate attachment of a hauling vehicle and thus further define a drawbar to said trailer, and wherein when the bar does not define a drawbar, means are further provided to keep the main frame substantially horizontal above the ground.

A non restrictive description of a preferred embodiment will now be given with reference to the appended drawings.

BRIEF DESCRIPTION OF THE DRAWINGS

FIG. 9 is a top view of the optional lift plate.

FIG. 10 is an enlarged perspective view of the junction between a rail and a cross member.

DESCRIPTION OF A PREFERRED EMBODIMENT

Figure 1:
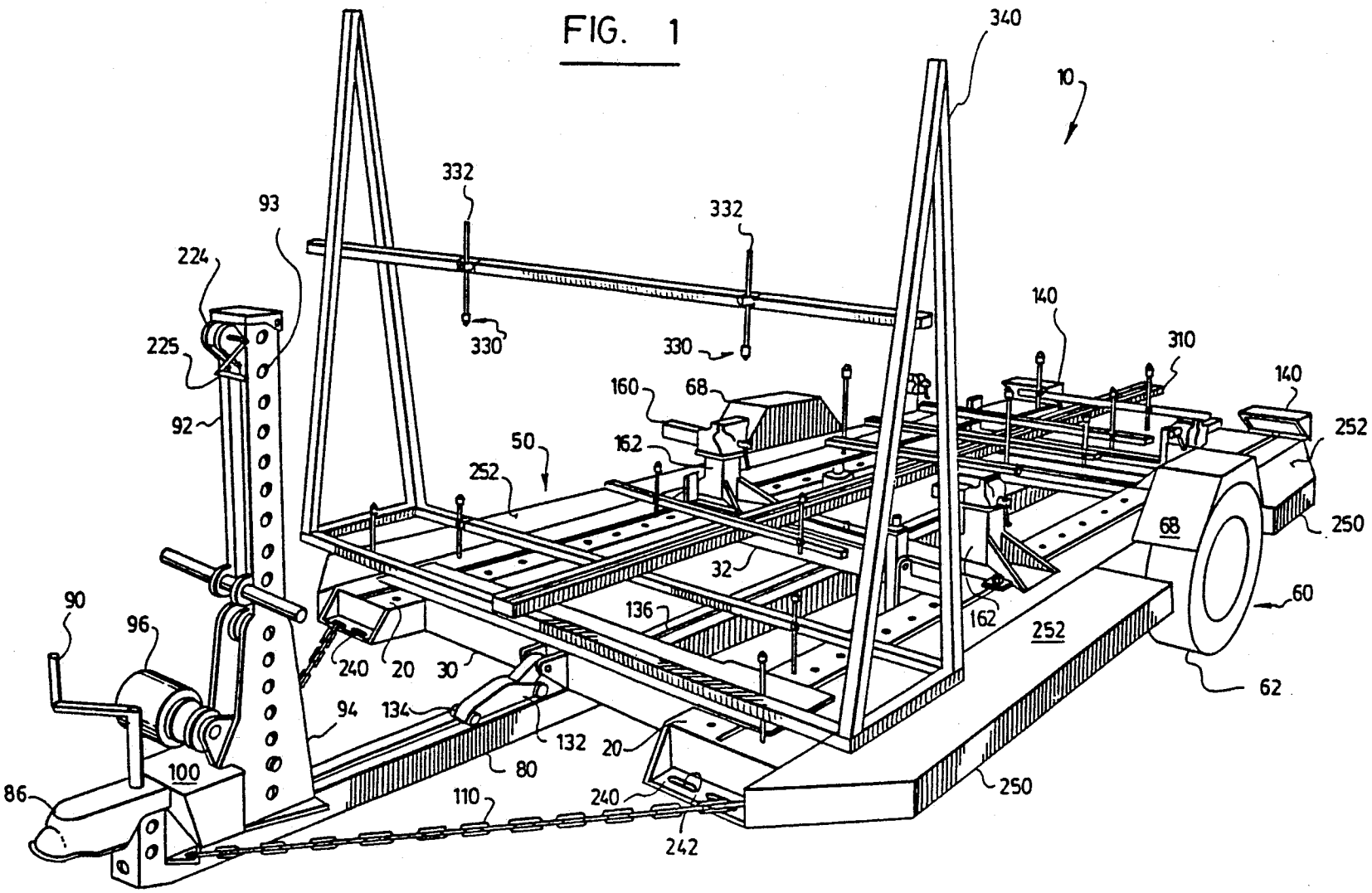
FIG. 1 is a perspective view of a trailer, according to the invention, showing some elements thereof.

The trailer, according to the invention and with references to the accompanying drawings, has the followings reference numerals:

10: trailer
12: bolts
14: nut
20: rails
21: end spacers
22: longitudinal slots (rails)
24: spacers
30: front cross member
32: first intermediary cross member
34: second intermediary cross members
36: rear cross member
38: longitudinal slots (cross members)
39: spacers
40: lower flange
42: upper flange
50: frame
60: wheel assembly
62: wheels
68: fenders
80: drawbar
82: front end (drawbar)
84: rear end (drawbar)
86: trailer hinge
90: hand jack
92: mast
93: holes (mast)
94: reinforcing flanges
96: electrical winch
98: cable
100: battery
110: security chains
120: misshapen car
130: T-bolt
132: hydraulic trolley jack
134: wheels (hydraulic trolley jack)
135: peg
136: slot (drawbar)
140: access ramps
160: vises
162: anvils
170: lift assembly
172: pneumatic lifting-jacks
174: lift plate
176: transverse beam
180: axle stands
190: bogey
192: free wheels (bogey)
194: intermediary free wheel
200: traction assembly
202: upper pulley
204: lower pulley
206: hydraulic jack
208: chain
210: sliding support
220: boom
222: reinforcement bar
224: pulley (mast)
225: hand crank
226: pulley (boom)
230: bolt (drawbar)
232: bolt (drawbar)
240: external slotted flanges
242: slots
250: tool boxes
252: sliding covers
300: metrology assembly
310: longitudinal bar
312: transverse bars
314: pivotable levels
316: swivels
318: nuts
319: hand-operated screws
320: slidable cross bar
330: gauges
332: axles
334: head
336: sliding vise
340: upper positioning assembly A preferred embodiment of the invention relates to an improvement in a trailer 10 of the type comprising:

(a) a main frame 50,
(b) a wheel assembly 60,
(c) a bar having a length and opposite ends which is intended to be releasably secured with the main frame,
(d) means to load a car on the main frame,
(e) means for firmly fastening rocker panels of said car with the main frame, said means being releasably secured to the main frame 50,
(f) reference means for positioning said parts of said misshapen frame under traction,
(g) optionally, means to lift said car.

Figure 2:
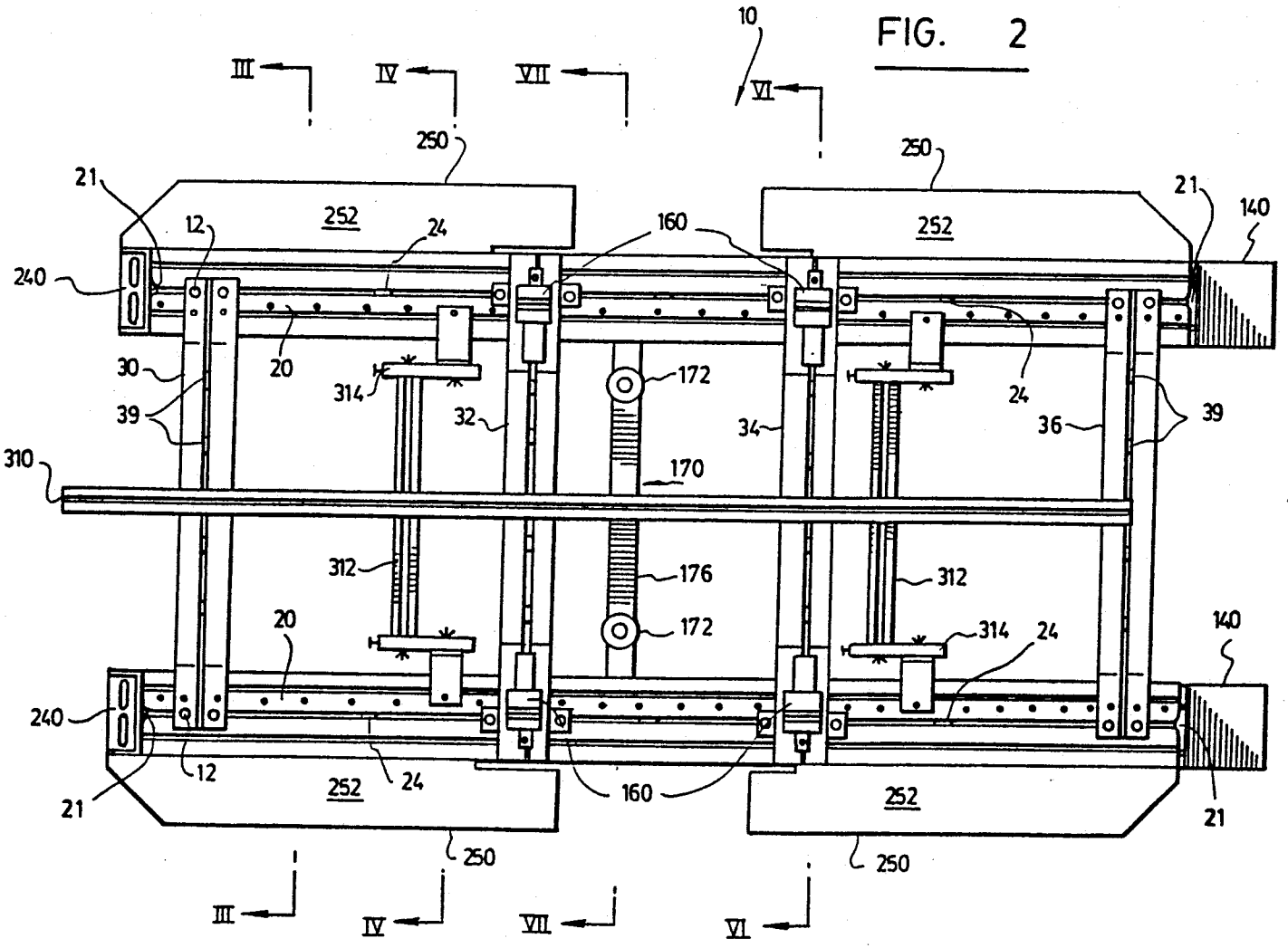
FIG. 2 is a partial top view of the trailer without the drawbar.
Figure 3:
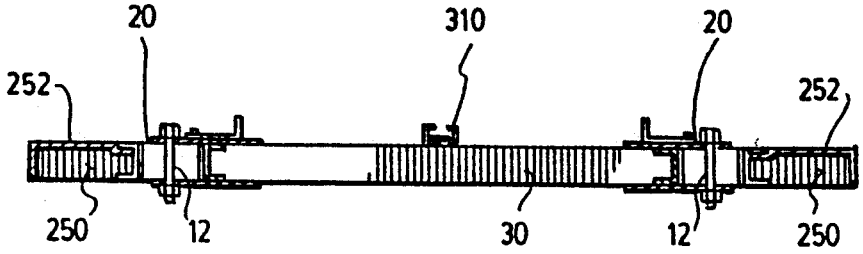
FIG. 3 is a cross-sectional view of the main frame according to line III—III of FIG. 2.

Each rail 20 may be made of two parallel beams spaced apart from each other to define a vertical slot 22 extending along substantially their entire length. End spacers 21 and small spacers 24 may link both beams (FIG. 2).

The left and right rails 20 may have four cross members having opposite ends, that is, a front cross member 30, a first intermediary cross member 32, a second intermediary cross member 34 and a rear cross member 36. Each cross member may be made of two parallel beams spaced apart from each other to define a longitudinal slot 38 extending along substantially their entire length. The longitudinal slots 22 and 38 have the same width.

Small spacers 39 may link both beams of the cross member. It is not essential to have four cross members. The minimum number is two, advantageously one at each end of the rails 20, but more cross members allow a better rigidity and solidity.

There are provided means for sliding one end of each cross member along a longitudinal axis of one corresponding rail 20, and the opposite end of each cross member along a longitudinal axis of another rail 20. As shown in FIG. 10, each end of the cross members 30, 32, 34 and 36 may have a lower flange 40 and an upper flange 42, both laterally projecting from the ends of the cross member. The flanges 40 and 42 project over the rails 20 for about ⅜ of the width of the rails 20, and they allow the cross members to be slid longitudinally.

There are also provided means for releasably securing one end of each cross member to one corresponding rail 20 and the opposite end of each cross member to another rail 20. Preferably, as shown in FIG. 10, the flanges 40 and 42 are flat plates and have holes aligned with the longitudinal slots 22 so bolts 12 may be inserted therein and screwed to nuts 14 for tightening the flanges on the rails 20, thus securing the cross members to the rails 20, the flanges 40 and 42 acting as vises around each rail 20. When the bolts 12 are removed, the cross members 30, 32, 34 and 36 may be slid and set to a nearby location.

The rails 20 and the cross members 30, 32, 34 and 36 define a main frame hereinafter called the frame 50.

A wheel assembly 60 is provided under the frame 50 to move the trailer 10 on the road between sites and to support it. It substantially comprises at least one pair of wheels with suspension means, means for sliding said pair of wheels along the longitudinal axis of each rail 20, and means for releasably securing said pair of wheels on said rails 20. Each pair of wheels substantially may comprise two conventional wheels 62 with tires, a non-rotating axle (not shown) on which the wheels 62 are operatively attached and suspension means. Brakes (not shown) can also be provided. More than one pair of wheels 62 may be provided.

The suspension means may comprise a pair of leaf springs (not shown) located right under the rails 20.

Means for sliding the wheels 62 along the longitudinal axis of each rail and means for releasably securing the wheels 62 with each of the rails 20 may comprise, for example, leaf springs having their upper portion releasably secured to the rails 20 by means of bolts 70 inserted in the longitudinal slots 22, passing through holes (not shown) made in the upper portion of the leaf springs. Nuts (not shown) close the lower end of the bolts 70 and tie the parts together.

Optionally, there may be also provided a pair of fenders 68, each fender 68 being located over one of the wheels 62. These fenders 68 are rigidly attached by any convenient means to the wheel assembly 60 and move along with it.

A bar, hereinafter called the drawbar 80, is provided at the front of the trailer 10 to haul it to a hauling vehicle (not shown), such as a car or a light truck. The drawbar 80 has opposite ends, that is a front end 82 and a rear end 84. The front end 82 is provided with a conventional trailer hinge 86 to attach the trailer 10 to the hauling vehicle when it has to be moved.

The drawbar 80 comprises means for releasably securing one end thereof with one corresponding rail or cross member, and means for releasably securing an intermediate portion thereof with one corresponding rail or cross member distinct from the one with which the end of the drawbar 80 is releasably secured. Advantageously, said means for releasably securing one end and an intermediate portion of the drawbar 80 with rail(s) 20 and/or cross member(s) 30, 32, 34, 36, comprise sets of bolts and nuts, said sets of bolts and nuts releasably securing, respectively, said end and intermediate portion under a corresponding rail 20 or cross member 30, 32, 34, 36, said bolts being inserted in a vertical slot 22 or 38.

Figure 14:
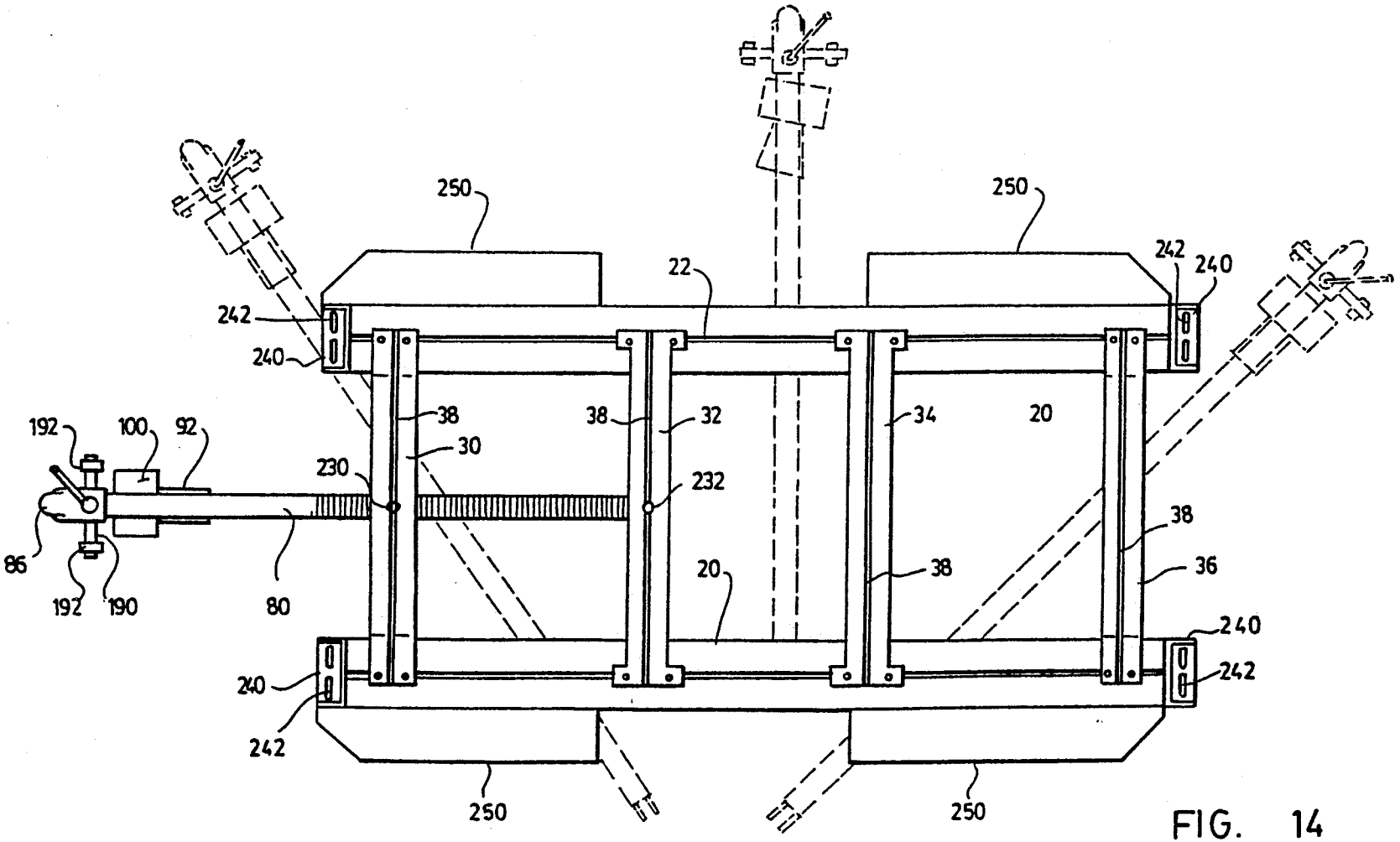
FIG. 14 is a schematic top view showing examples of positions of the drawbar around the trailer.

As shown in FIG. 14, the rear end 84 of the drawbar 80 may be releasably secured to the first intermediary cross member 32 by means of a bolt 232 inserted in the longitudinal slot 38 thereof and engaged with a nut. Additionally, an intermediary point on the drawbar 80 may be releasably secured to the front cross member 30, also by means of a bolt and a nut inserted in the longitudinal slot 38 thereof.

Optionally, the drawbar 80 may be further provided with a plurality of wheels 192, 194 located under it. Those wheels contribute to make easier the movements of the drawbar 80 when detached from the main frame 50.

The drawbar 80 may further comprise an optional hand jack 90 located near the front end 40. The jack 90 is used to lift the front end 40 when the trailer 10 is detached from the hauling vehicle.

The drawbar 80 also comprises a mast 92 provided with means for releasably securing it on the drawbar 80 near the front end 82 thereof. Preferably, the mast 92 can be oriented a few degrees on both sides. The mast 92 may be releasably secured to the drawbar 80 by means of a swivel (not shown) and a bolt and nut inserted in a curved slot (not shown). Front and rear reinforcing flanges 94 may be provided at the base of the mast 90 to make sure that it is always in a vertical position. The drawbar 80 may also be provided with pulling means 200 releasably fastened on the mast 92 and intended to mechanically connect a part of the misshapen frame with the mast 92 to thus exert a traction on parts of the misshapen frame. Preferably, pulling means 200 may comprise a hydraulic jack pulling a chain mechanically connected to one of said parts of said misshapen frame.

Moreover, the drawbar 80 may also comprise means to load the car 120 on the frame 50, such as an electrical winch 96 with a steel cable 98. The electrical winch 96 is powered by a conventional 12-Volts battery 100. The battery 100 may be charged by the hauling vehicle when the trailer 10 is hauled, or by means such as an overnight charger (not shown). The battery 100 may be used to power the electric winch 96 and for a pneumatic compressor (not shown) when the trailer 10 is not linked to any other power source.

The above-mentioned trailer 10 is improved in that the drawbar 80 may be releasably secured with the main frame 50 at two distant points thereof and at any location all around it, and, said drawbar being intended, when substantially parallel with the rails 20, to have one end releasably secured with one cross member (e.g. cross member 32) and an intermediate portion releasably secured with another cross member (e.g. cross member 30), and have its end 82 provided with means for releasably securing it with an appropriate attachment of a hauling vehicle to thus further define a drawbar to said trailer 10. Of course, when the drawbar 80 is not secured with the appropriate attachment of a hauling vehicle, means are further provided to keep the main frame 50 substantially horizontal above the ground. (Such means may comprise, for example, axle stands 180.) Advantageously, means to load a car on the main frame 50 may further comprise means to tilt said main frame 50. Those means to tilt the main frame may preferably comprise hinge means operatively attaching said bar to one of said cross members, and a hydraulic trolley jack located on said bar and fixed to a front cross member.

According to a preferred embodiment, means to load (or unload) said misshapen unibody frame on the trailer 10 may further comprise tiltable or retractible access ramps operatively attached to each rail 20.

Advantageously, aforesaid reference means may comprise:

a longitudinal bar, used to define a datum-line, operatively attached to said main frame by means of transverse bars and pivotable levels, said longitudinal bar being transversally translatable and adjustable in height;

at least one slidable cross bar realisably secured to said longitudinal bar and transversely located thereon; and at least one gauge having an axle realisably secured to said slidable crossbar and projecting therefrom, said gauge having a sharp end acting as a reference point.

When the trailer 10 is hauled, security chains 110 may be provided between the front of each rail 20 and the front end 40.

The trailer 10 is then hauled to a site where the misshapen car 120 is located. The repairs can be carried out at that site or at another location. In the latter case, the car 120 is put on the trailer 10 and driven away with the trailer 10.

To help the car 120 be set on the frame 50, the frame 50 is tilted. This is preferably achieved by removing the bolts and nuts securing the drawbar 80 to the frame 50, and by using a T-bolt 130 acting as a swivel located between the rear end 84 of the drawbar 80 and the first intermediary cross member 32.

Figure 11:
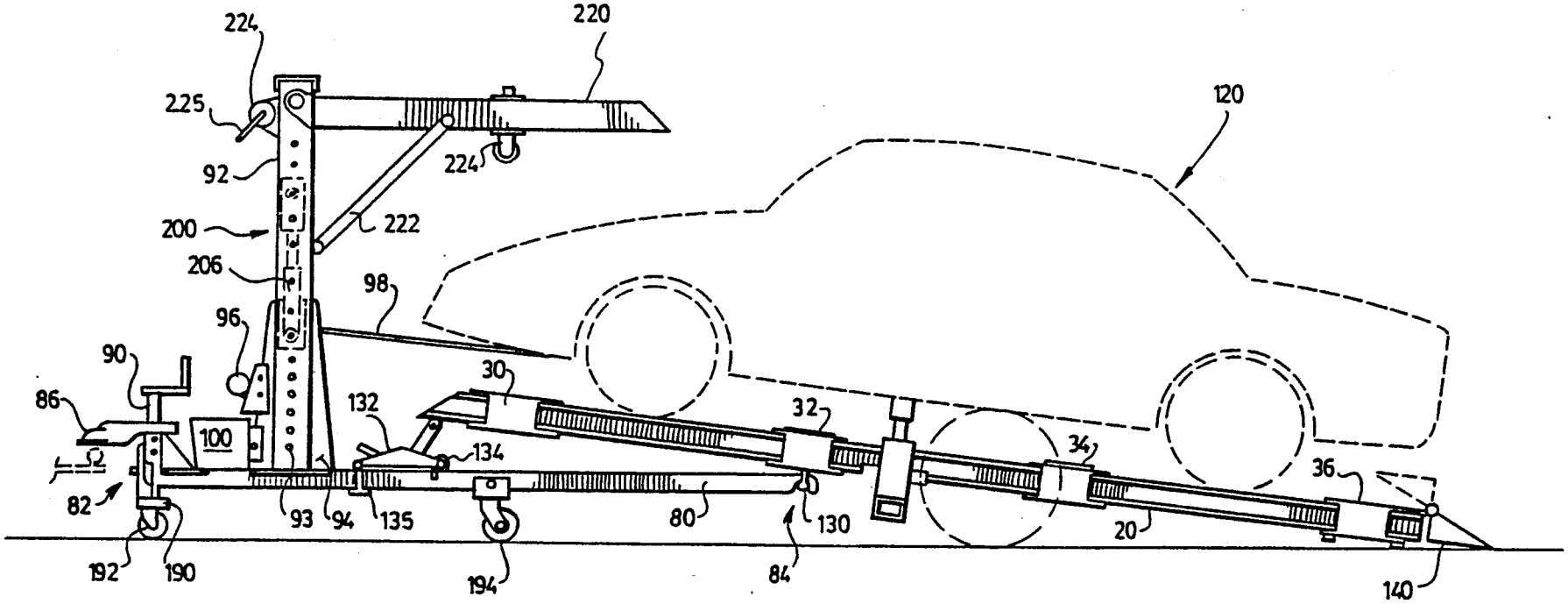
FIG. 11 is a side elevational view showing a car moved over the main frame.

As shown in FIG. 11, to tilt the frame 50, a hydraulic trolley jack 132 may be set on the intermediary location on the drawbar 80 to lift the front cross member 30. The hydraulic trolley jack 132 is preferably provided with wheels 134, so it can roll over the drawbar 80. A slot 136, may be provided on the drawbar 80, to guide the hydraulic trolley jack 132, which has a small peg 135 projecting thereunder in the slot 136.

Two access ramps 140 may be provided at the rear of the trailer 10 to help the car 120 get on the frame 50. These access ramps 140 are advantageously tiltable between a tilted position and a ground-engaged position, and are preferably operatively attached to the rails 20 by means of hinges. When the access ramps 140 are at their tilted position, they may show brake lights (not shown) facing the rear. A retractable license plate (not shown) is provided on one of the access ramps 140. It is also possible that the access ramps 140 be retractable instead of tiltable.

When the car 120 is moved on the frame 50, it may be pulled by the cable 98 of the electrical winch 96. When the car 120 is in place, the frame 50 may be reset horizontally by lowering the arm of the hydraulic trolley jack 132.

Figure 6:
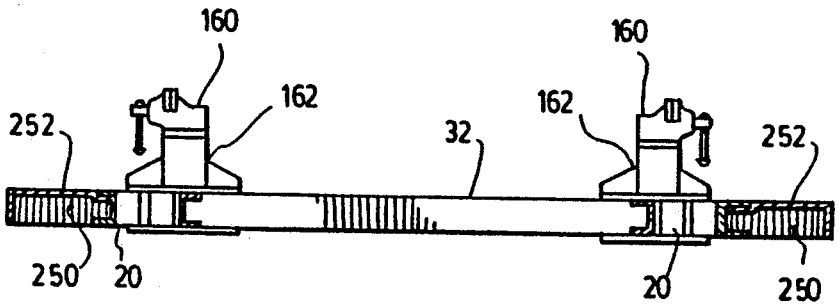
FIG. 6 is a partial cross-sectional view of the main frame showing a pair of vises mounted on anvils, according to line VI—VI of FIG. 2.

Since the traction that has to be exerted on parts of the car 120 is very important and the realignment has to be very precise, the car 120 is solidly attached to the frame 50 by its rocker panels located thereunder (not shown). As shown in FIG. 2, four vises 160 may be provided to preferably define said means for firmly fastening rocker panels of said car to the main frame. Each vise grabs a portion of a corresponding rocker panel. The vises 160 may be secured to anvils 162, which are releasably secured to the frame 50 (FIG. 6). Those anvils 162 may define a preferred embodiment of the releasably securing of said means to the main frame 50.

Figure 7:
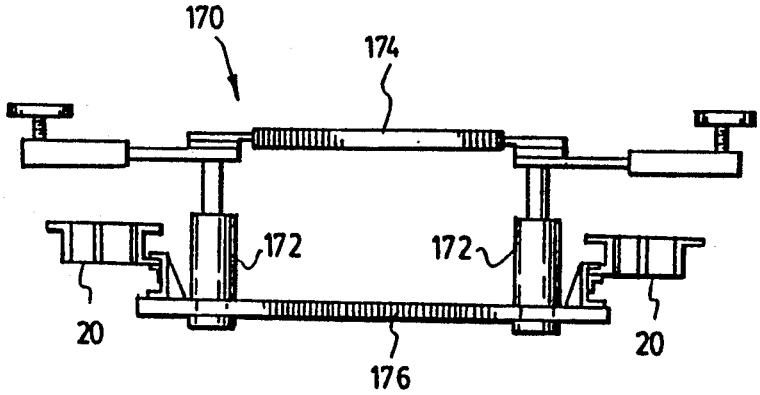
FIG. 7 is a partial cross-sectional view of the frame showing the lift assembly according to line VII—VII of FIG. 2, and an optional lift plate.

To get the rocker panels into the vises 160, the car 120 may be lifted by means of a lift assembly 170 releasably secured to the frame 50. It may comprise two pneumatic lifting-jacks 172 operating simultaneously. A lift plate 174 (FIGS. 7 and 9) may be provided over the pneumatic lifting-jacks 172 to reach four lifting points (not shown) located under the car 120. The lift plate 174 is fully adaptable to cars of any size as a conventional lift plate found in car repair shops. The car 120 is lifted integrally. The compressed air may be provided by means of a conventional 12-Volts compressor (not shown) located in one of the tool boxes 250.

Figure 8:
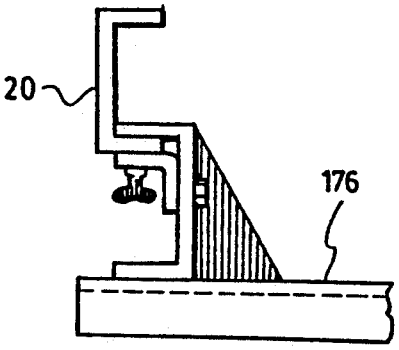
FIG. 8 is an enlarged cross-sectional view of the junction between a rail and the transverse beam supporting the lift assembly.
Figure 12:
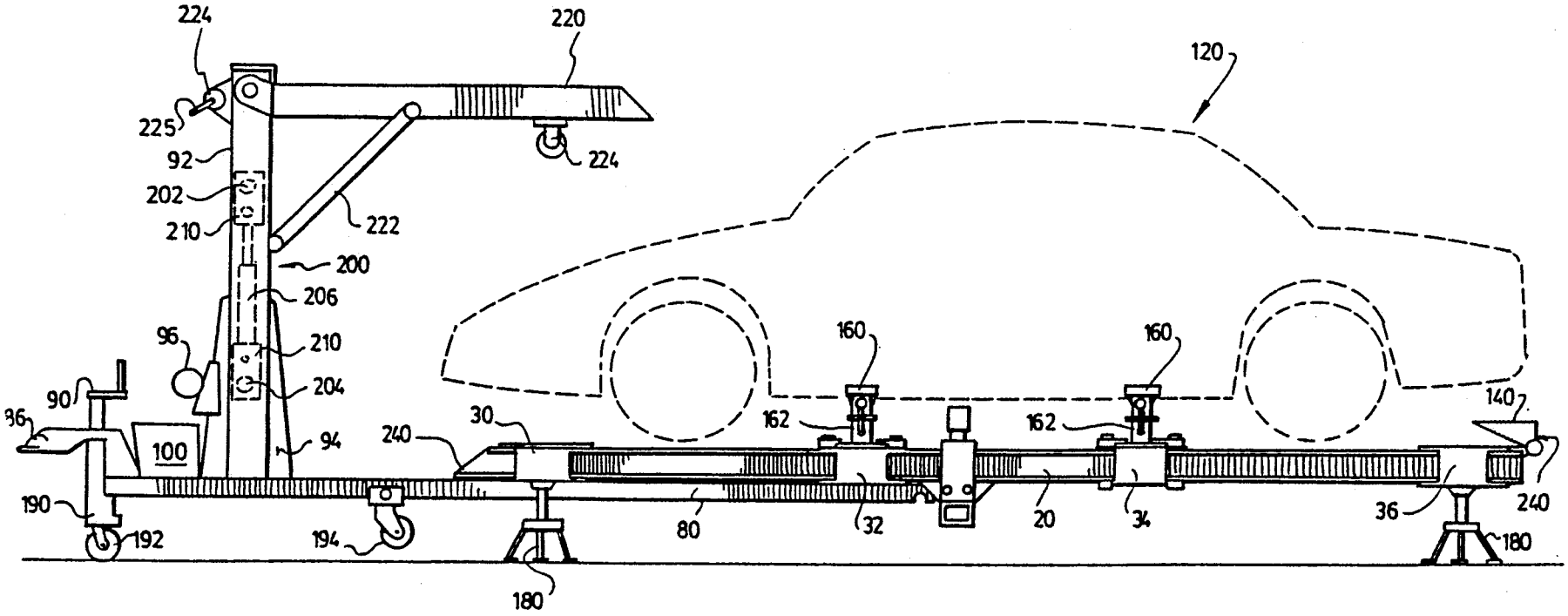
FIG. 12 is a side elevational view showing the car over the frame and attached to the vises by the rocker panels, and with the wheel assembly removed.
Figure 13:
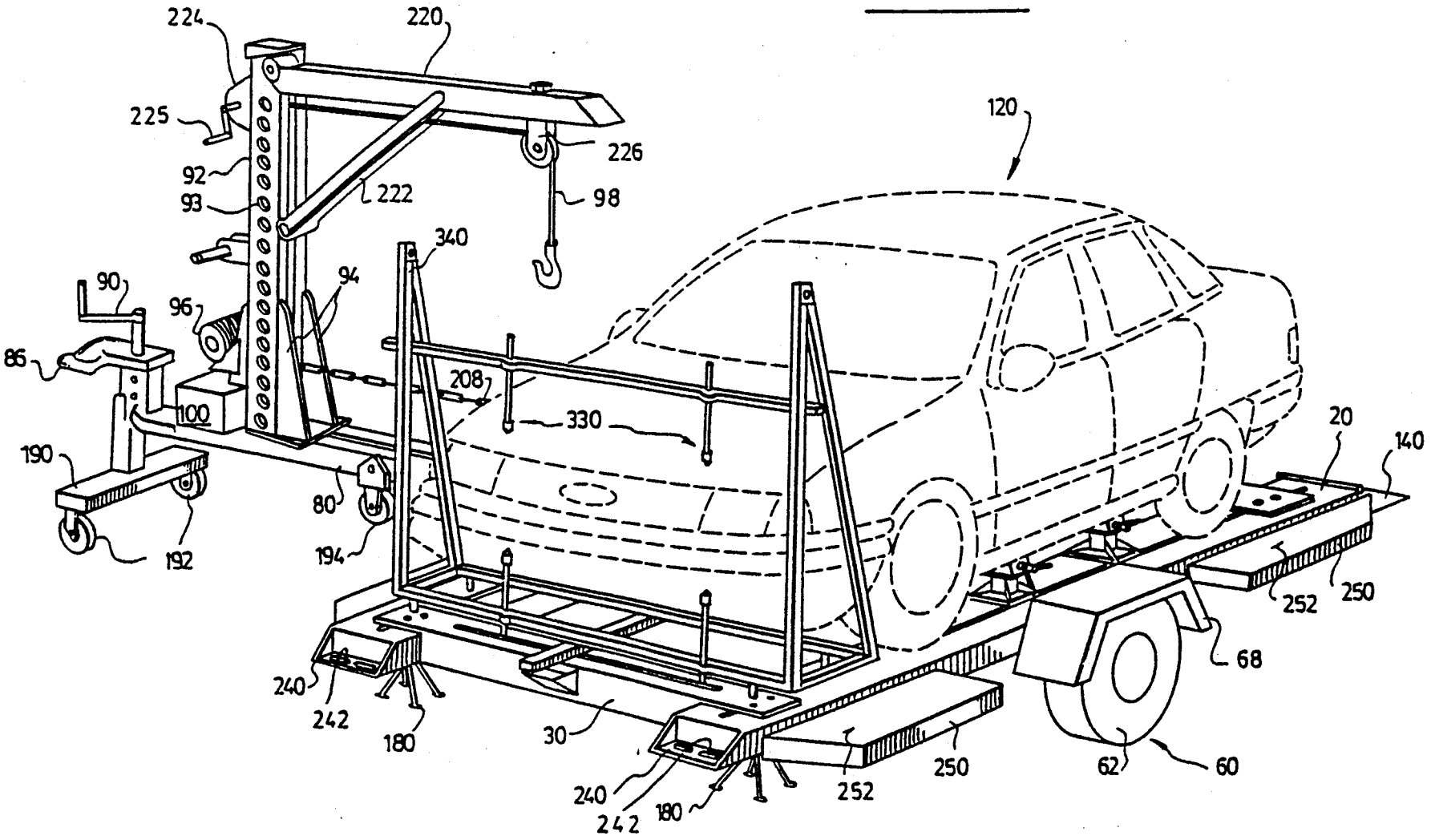
FIG. 13 is a perspective view of the car under repair.

When the car 120 is at an elevated position, the vises 160 and their corresponding anvil 160 are preferably set under the car 120 at their appropriate location thereunder, and the anvils 162 are secured to the frame 50 by means of bolts and nuts. When the car 120 is secured to the vises 160, its wheels may or may not touch the rails 20, as shown in FIG. 12. The pneumatic pistons 172 are lowered afterwards. The lift assembly 170 may be advantageously mounted on a transverse beam 176 which is located under the frame 50 and which can be slid longitudinally. Both ends of the transverse beam 176 may be releasably secured to the rails 20. FIG. 8 shows details of the junction between the rails 20 and the transverse beam 176.

One of the main features of the present invention is that the drawbar 80, which includes the means to exert a traction on parts of the car 120, can be removed from its hauling position and set anywhere around the frame 50. Furthermore, because it is fastened at two distant positions on the main frame 50, it is possible to use a high pulling force without bending and/or damaging the main frame 50.

Before moving the drawbar 80, the hydraulic trolley jack 132 is removed and axle stands 180 are preferably set under the trailer 10 to stabilize it and to level it.

To easily move the drawbar 80, a bogey 190 may be provided at the lower end of the jack 90. The bogey 190 preferably has two ground-engaged free wheels 192 transversally disposed. An intermediary ground-engaged free wheel 194 is provided at approximately mid-length of the drawbar 80. The wheel 194 may act as a swivel for the lifting of the rear end 84. By lowering the hand jack 90, thus the front end 82, the rear end 84 is lifted and brought closer to the rails 20 or the cross members.

As shown in FIG. 12, the mast 92 may enclose a traction assembly 200 vertically disposed and able to slide therein. This traction assembly 200 preferably comprises an upper pulley 202, a lower pulley 204, a hydraulic jack 206 located between the pulleys, and a chain 208 winded around the pulleys. The pulleys 202 and 204 are operatively attached to sliding supports 210 and the hydraulic jack 206 is attached thereto. Although a cable might have been used instead of a chain 208, the chain 208 is more resistant.

In use, one of the pulleys 202 and 204 is attached to one of the holes 93 on the mast 92, with a peg (not shown) or a similar item, and the other pulley remains free to slide. The chain 208 has one end attached to the part under realignment and the other end fixed on the mast 92. The chain 92 is first winded around the fixed pulley and secondly around the movable pulley. When the hydraulic jack 206 is operated, it moves the free pulley apart from the fixed one, therefore inducing a traction on the chain 208.

The traction assembly 200 may be lifted or lowered by means of the pulley 224. The pulley 224 may comprise a hand crank 225.

The mast 92 may also preferably feature a horizontal boom 220 located at its upper end and attached thereat. Preferably, a reinforcing bar 222 helps keeping the boom 220 horizontal. The boom 220 may be used for exerting upper traction or for lifting heavy weights, such as lifting the engine of the car 120. A pulley 224 located at the apex of the mast 92 may be used to lift the boom 220 with the cable 98 of the electrical winch 96. When using the boom 220, a pulley 226 may be provided under it and the chain 208 is winded around.

As mentioned earlier, the drawbar 80 can be set anywhere around the trailer 10. When the suitable angle of pulling is determined, the drawbar 80 is locked in place by means of bolts 230 inserted in the longitudinal slots 22 or 38 or even a combination of both. To attach the drawbar 80 to a point located at one of the ends of the rails 20, there is provided external slotted flanges 240, having a pair of slots 242, located at the front of the rails 20 and at the rear thereof. The rear flanges 240 may be bolted to end spacers 21 located at the rear of the rails 20.

The bolts 12 and the bolts 230 are preferably identical. As shown in FIG. 9, the bolts may have two parallel machined faces to ease their insertion in the slots since the diameter of the bolts are very close to the width of the slots. Preferably, the machined faces give the opportunity to lock the bolts in place by forcing them to turn. Therefore, since the tolerance is low, the non-machined faces of the bolts will be stuck in the slots.

Tool boxes 250 are optionally rigidly attached to the trailer 10 and laterally projecting therefrom. They may comprise sliding covers 252 which act as foot board when closed. The use of sliding covers allows an easy access to the tool boxes 250 even if the car 120 is wide.

The purpose of providing means to allow a displacement of the cross members 30, 32, 34, 36 and wheel assembly 60 is that when the car 120 is under repair on the trailer 10, if a specific job has to be done under the car 120 or at lower portions thereof and the cross members or wheel assembly 60 is in the way, they can be moved rearwardly or forwardly to permit an easier access.

To ease the sliding of the cross members or the wheel assembly 60, a cross stiffness bar (not shown) may be provided to help to maintain both rails 20 parallel since loads such as the weight of the car 120 may cause a slight torsion of the frame 50.

To achieve a proper and precise realignment of a misshapen unibody car, there must be provided reference means for positioning said parts of said misshapen frame under traction. Such reference means, for example, may comprise a metrology assembly 300 to replace all parts at their proper location with reference to one another. By looking at the specifications of the body of the car 120, it is possible to realign it properly. The measures are taken from points on intact parts of the body. From there, the spatial positioning of all other parts can be calculated with the specifications of the car.

Figure 4:
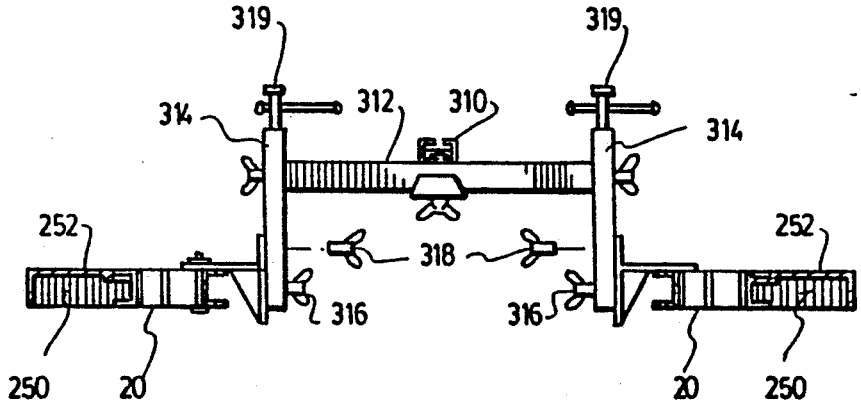
FIG. 4 is a cross-sectional view of the main frame showing the elements for positioning the datum line bar, according to line IV—IV of FIG. 2, in an upward position.
Figure 5:
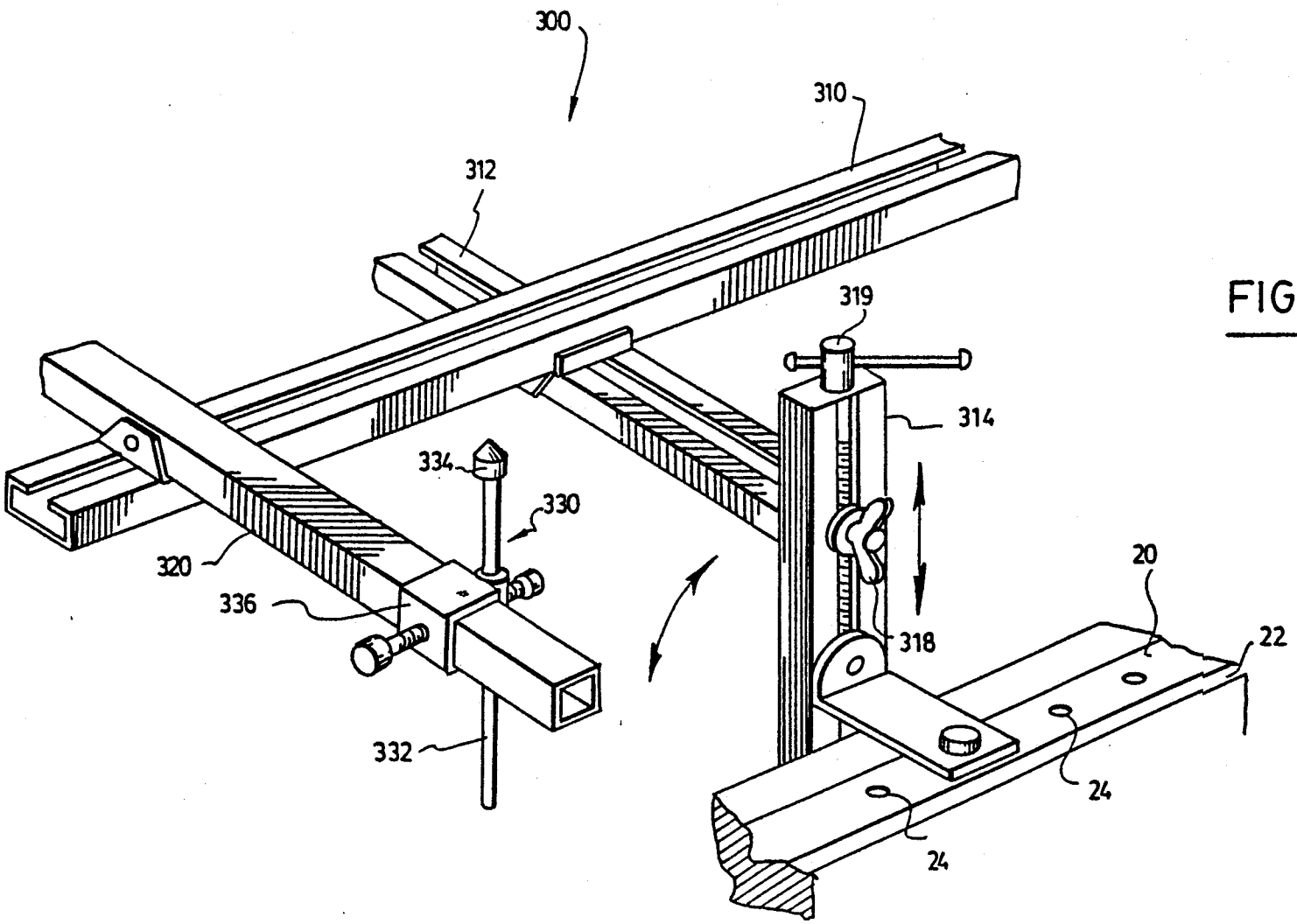
FIG. 5 is an enlarged partial perspective view of the longitudinal bar defining the datum line.

As shown in FIGS. 4 and 9, reference means for positioning the parts of the misshapen frame under traction may preferably comprise a longitudinal bar 310, which is provided on the trailer 10 to define a reference line, called the datum line. The longitudinal bar 310 is operatively attached to a transverse bar 312. The transverse bars 312 are operatively attached, at their ends, to one of the ends of pivotable levels 314, the opposite ends of the pivotable levels 314 being operatively attached to the frame 50. The junctions on the pivotable levels 314 define a set of swivels 316 which allow the longitudinal bar 310 to be toppled aft and forth. Nuts 318 lock the elements in a proper position. Additionally, a hand-operated screw 319 is provided on the pivotable levels 314 to adjust the height of the transverse bars 312. Moreover, the longitudinal bar 310 can be moved laterally on the transverse bars 312. The whole metrology assembly 300 may be moved aft and forth by resetting it in different holes 24.

As shown in FIG. 1, a plurality of slidable cross bars 320 are secured to the longitudinal bar 310. Each of the slidable cross bars 320 is provided with one or a plurality of gauges 330 having a head and an axle 332. The axle 332 is set in a sliding vise 336. Some of the gauges 330 are set at designated locations in intact parts of the car 120. Others are set at locations to guide the realignment of misshapen parts of the car 120 and are used to show how far a part has to be pulled to realign it, according to the art known to the persons skilled in the art of realignment. In some cases, an upper positioning assembly 340 may be used to get points on upper or side parts of the car 120. The heads 334 have a sharp end pointing out the specific spacial locations.

Prior to the installation of the gauges 330, the frame 50 is levelled to have a great precision when measuring.

To fully understand how the present invention works, the following shows the steps of use:

(a) moving the trailer 10 to a location where the misshapen car 120 is stored;
(b) moving the car 120 on the frame 50;
(c) positioning the main frame substantially horizontally above the ground, preferably with levels;
(d) fastening the rocker panels to the vises;
(e) releasing the drawbar 80 from the frame 50;
(f) positioning and releasably securing the drawbar 80 to the frame 50 to any desired location thereabouts;
(g) exerting traction on misshapen parts of car 120 with reference to the metrology assembly;
(h) moving the cross members 30, 32, 34, 36 or the wheel assembly if necessary;
(h) moving the car 120 off the frame 50 when repaired.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What I claim is:

1. In a trailer adapted for rectifying the shape of a unibody car having a misshapen frame, said trailer comprising:

(a) a main frame comprising:
at least two rails,
at least two cross members having opposite ends,
means for sliding one end of each cross member along a longitudinal axis of one corresponding rail, and the opposite end of each cross member along a longitudinal axis of another rail, and means for releasably securing one end of each cross member to one corresponding rail and the opposite end of each cross member to another rail;

(b) a wheel assembly comprising:

at least one pair of wheels with suspension means, means for sliding said pair of wheels along the longitudinal axis of each rail, and means for releasably securing said pair of wheels with each of said rails;

(c) a bar having a length and opposite ends, said bar comprising:

means for releasably securing one end of said bar with one corresponding rail or cross member, means for releasably securing an intermediate portion of said bar with one corresponding rail or cross member distinct from the one with which the end of said bar is releasably secured, a mast provided with means for releasably securing it on said bar near the end opposite the one releasably secured with a rail or cross member, pulling means releasably fastened on said mast and intended to mechanically connect a part of said misshapen frame with the mast to thus exert a traction on parts of said misshapen frame;

(d) means to load said car on said main frame;

(e) means for firmly fastening rocker panels of said car to said main frame, said means being releasably secured to said main frame; and (f) reference means for positioning said parts of said misshapen frame under traction;

the improvement wherein said bar is releasably secured to the main frame at two distant points thereof and at any location around said main frame, said bar being intended, when substantially parallel with rails, to have one end releasably secured with one cross member, an intermediate portion releasably secured with another cross member and its opposite end provided with means for releasably securing it with an appropriate attachment of a hauling vehicle to thus further define a drawbar to said trailer, and wherein when the bar does not define a drawbar, means are further provided to keep the main frame substantially horizontal above the ground.

2. An improved trailer according to claim 1, wherein rails and cross members have a vertical slot extending from side to side along substantially their entire length for the insertion therein of said means for releasably securing said ends of said cross members to said rails.

3. An improved trailer according to claim 2, wherein means for releasably securing one end and an intermediate portion of said bar with rails and/or cross members comprise sets of bolts and nuts which are respectively releasably securing said end and said intermediate portion under a corresponding rail or cross member, said bolts being inserted in said vertical slots of said rails or cross members.

4. An improved trailer according to claim 3, wherein said means for sliding said ends of cross members comprise upper and lower flanges laterally projecting from the ends of said cross members.

5. An improved trailer according to claim 4, wherein said means for releasably securing said ends of said cross members to said rails comprise bolts and nuts tightening said flanges on said rails.

6. An improved trailer according to claim 3, wherein said pulling means comprise a hydraulic jack pulling a chain mechanically connected to one of said parts of said misshapen frame.

7. An improved trailer according to claim 2, wherein means for releasably securing said set of at least one pair of wheels with each of said rails comprise a set of bolts and nuts tightening said means for sliding said pair of wheels to a location under said rails, said bolts being inserted in said vertical slots of said rails.

8. An improved trailer according to claim 1, further comprising a plurality of wheels located under said bar to move the same when detached from said main frame.

9. An improved trailer according to claim 1, wherein means to load said car on said main frame comprise means to tilt said main frame.

10. An improved trailer according to claim 9, wherein means to tilt said main frame comprise hinge means operatively attaching said bar to one of said cross members, and a hydraulic trolley jack located on said bar and fixed to a front cross member.

11. An improved trailer according to claim 10, wherein means to load said misshapen unibody frame on said trailer comprise tiltable or retractable access ramps operatively attached to said rails.

12. An improved trailer according to claim 1, wherein said reference means comprise:

a longitudinal bar, used to define a datum-line, operatively attached to said main frame by means of transverse bars and pivotable levels, said longitudinal bar being transversally translatable and adjustable in height;

at least one slidable cross bar realisably secured to said longitudinal bar and transversely located thereon; and at least one gauge having an axle realisably secured to said slidable crossbar and projecting therefrom, said gauge having a sharp end acting as a reference point.

13. In a trailer adapted for rectifying the shape of a unibody car having a misshapen frame, said trailer comprising:

(a) a main frame comprising:

at least two rails, at least two cross members having opposite ends, means for sliding one end of each cross member along a longitudinal axis of one corresponding rail, and the opposite end of each cross member along a longitudinal axis of another rail, said means comprising upper and lower flanges laterally projecting from the ends of said cross members, vertical slots extending from side to side of said rails and cross members along substantially their entire length;

bolts and nuts tightening said flanges on said rails for releasably securing one end of each cross member to one corresponding rail and the opposite end of each cross member to another rail, said bolts being inserted in said vertical slots of said rails or cross members, and (b) a wheel assembly comprising:

a pair of wheels with suspension means, means for sliding said pair of wheels along the longitudinal axis of each rail, bolts and nuts tightening said means for sliding said pair of wheels to a location under said rails, said bolts being inserted in said vertical slots of said rails;

(c) a bar having a length and opposite ends, said bar comprising:

means for releasably securing one end of said bar with one corresponding rail or cross member, bolts and nuts for releasably securing an intermediate portion of said bar with one corresponding rail or cross member distinct from the one with which the end of said bar is releasably secured, a mast provided with means for releasably securing it on said bar near the end opposite the one releasably secured with a rail or cross member, and a hydraulic jack pulling a chain mechanically connected to parts of said misshapen frame for exerting a traction thereon;

(d) means to load said car on said main frame;

(e) vises for firmly fastening rocker panels of said car to said main frame, said vises being releasably secured to said main frame;

(f) means to tilt said main frame comprising a hinge means operatively attaching said bar to one of said cross members, a hydraulic trolley jack located on said bar, and tiltable or retractable access ramps operatively attached to said rails;

(g) means to lift said car;

(h) a plurality of wheels located under said bar to move the same when detached from said main frame;

(i) reference means for positioning parts of said unibody frame under traction, said reference means comprising:

a longitudinal bar, used to define a datum-line, operatively attached to said main frame by means of transverse bars and pivotable levels, said longitudinal bar being transversally translatable and adjustable in height;

at least one slidable cross bar realisably secured to said longitudinal bar and transversely located thereon; and at least one gauge having an axle realisably secured to said slidable cross bar and projecting therefrom, said gauge having a sharp end acting as a reference point;

the improvement wherein said bar is releasably secured to the main frame at two distant positions thereof and at any location around said main frame, said bar being intended, when substantially parallel with rails, to have one end releasably secured with one cross member, an intermediate portion releasably secured with another cross member and its opposite end provided with means to releasably secure it with an appropriate attachment of a hauling vehicle to thus further define a drawbar to said trailer, and wherein, when the bar does not define a drawbar, means are further provided to keep the main frame substantially horizontal above the ground.

* * * * *